US010115551B2

(12) United States Patent
Kupsch

(10) Patent No.: US 10,115,551 B2
(45) Date of Patent: Oct. 30, 2018

(54) PROTECTIVE CIRCUIT BREAKER

(71) Applicant: Siemens Aktiengesellschaft, Munich (DE)

(72) Inventor: Alexander Kupsch, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 301 days.

(21) Appl. No.: 15/194,664

(22) Filed: Jun. 28, 2016

(65) Prior Publication Data

US 2017/0018388 A1 Jan. 19, 2017

(30) Foreign Application Priority Data

Jul. 15, 2015 (DE) ..... 10 2015 213 240

(51) Int. Cl.

| | |
|---|---|
| ***H01H 1/06*** | (2006.01) |
| ***H01H 71/02*** | (2006.01) |
| ***H01H 71/08*** | (2006.01) |
| ***H01H 71/12*** | (2006.01) |

(52) U.S. Cl.

CPC ..... *H01H 71/025* (2013.01); *H01H 71/08* (2013.01); *H01H 71/125* (2013.01)

(58) Field of Classification Search

CPC ..... H01H 50/545

USPC ..... 335/131

See application file for complete search history.

(56) References Cited

U.S. PATENT DOCUMENTS 3,382,469 A * 5/1968 Conner ..... H01H 50/22 335/131
4,506,242 A * 3/1985 Karpe ..... H01H 51/20 335/119
5,099,385 A * 3/1992 Faffart ..... H01H 50/541 335/131

(Continued)

FOREIGN PATENT DOCUMENTS

| | | | |
|---|---|---|---|
| CN | 202363381 | U | 8/2012 |
| DE | 102006009220 | A1 | 9/2007 |
| DE | 102011083921 | A1 | 4/2013 |

OTHER PUBLICATIONS

Chinese Office Action dated Dec. 27, 2017.

*Primary Examiner* — Alexander Talpalatski
(74) *Attorney, Agent, or Firm* — Harness, Dickey & Pierce, P.L.C.

(57) ABSTRACT

A protective circuit breaker includes a switch housing; connection pieces; a switching contact arranged in the switch housing and connected to the connection pieces; a converter housing including a first passage opening and inserted into a recess in the switch housing and through which the second connection piece runs; a converter coil being arranged around the passage opening/the second connection piece; a plate-like converter cover including a second passage opening through which the second connection piece extends. In order to permit a simple voltage tap, in an embodiment the converter cover has arranged on it: a first contact bearing against the second connection piece at the converter cover, a second contact electrically connected to the first connection piece, and a third contact connected to the first or a second electronics system. An electrical connection is included, via which the third contact is selectively connectable to the first or second contact.

4 Claims, 3 Drawing Sheets

(56) References Cited

U.S. PATENT DOCUMENTS

| | | | | |
|---|---|---|---|---|
| 7,034,643 | B1 * | 4/2006 | Kusumoto | F02N 15/067 335/126 |
| 7,609,137 | B2 * | 10/2009 | Roesner | H01H 71/08 200/293 |
| 2009/0108967 | A1 * | 4/2009 | Parker | H02H 1/0015 335/20 |

* cited by examiner

PROTECTIVE CIRCUIT BREAKER

PRIORITY STATEMENT

The present application hereby claims priority under 35 U.S.C. § 119 to German patent application number DE 102015213240.4 filed Jul. 15, 2015, the entire contents of which are hereby incorporated herein by reference.

FIELD

At least one embodiment of the invention generally relates to a protective circuit breaker.

BACKGROUND

Protective circuit breakers are known, for example, in the form of low-voltage circuit breakers. Protective circuit breakers of this kind have a switch housing in which a switching contact for at least one voltage phase is arranged, the contact elements of the switching contact resting against one another when the switching contact is closed and being separated from one another when the switching contact is open. In this case, one contact element is designed such that it can move.

The two contact elements of the switching contact are each electrically connected to a connection piece, which connection pieces extend on the rear side of the switch through the switch housing to the outside. The connection pieces are each connected to a main busbar.

In order to fulfill the protective function, converters are provided which are arranged in a converter housing which has a passage opening through which one of the two connection pieces runs. At least one converter coil is arranged in the converter housing around the passage opening and therefore around a connection piece and is connected to an electronics system. The electronics system processes the converter signals and opens the switching contact, for example in the event of a short circuit. The converter housing is expediently located in a recess in the switch housing. The converter housing is covered to the outside by a plate-like converter cover. The converter cover likewise has a passage opening through which the connection piece which extends through the converter housing runs.

It is often desirable for the protective circuit breaker to be equipped with a voltage measuring system which taps off the voltage from the connection pieces and therefore from the main busbars and detects the voltage profile with respect to time. The voltage tap has to meet relatively strict requirements in respect of insulation and mechanical strength in order to be able to withstand the electrical and mechanical loads.

SUMMARY

The inventor proposes, in at least one embodiment, a simple voltage tap which satisfies strict requirements in respect of insulation and mechanical strength and takes place selectively at one of the two connection pieces.

The claims constitute advantageous refinements.

At least one embodiment provides that that side of the converter cover which faces the switch housing of the protective circuit breaker has arranged on it: a) a first contact which bears against the second connection piece at the converter cover in the region of the passage opening, b) a second contact which is electrically connected to the first connection piece, and c) a third contact which is connected to the first or a second electronics system, and comprising an electrical connection by way of which the third contact can be selectively connected to the first or second contact.

At least one embodiment is directed to a protective circuit breaker comprising:

a switch housing;

a first and a second connection piece, each of the first and a second connection pieces extending on a rear side through and outside the switch housing and each of the first and a second connection pieces being connectable to a busbar;

a switching contact, arranged in the switch housing, including two contact elements configured to rest against one another when the switching contact is closed and configured to separate from one another when the switching contact is open, wherein at least one of the two contact elements is designed to be movable, and wherein the two contact elements are each respectively electrically connected to a respective one of the first and a second connection pieces;

a converter housing, including a first passage opening, inserted into a recess in the switch housing, wherein the second connection piece runs through the first passage opening;

a converter coil, arranged in the converter housing around the passage opening and around the second connection piece, connectable to a first electronics system to trigger opening of the switching contact;

a plate-like converter cover, covering the converter housing to the outside and including a second passage opening through which the second connection piece extends and runs to the outside, a side of the plate-like converter cover, facing the protective circuit breaker, including arranged on thereon

- a first contact bearing against the second connection piece at the plate-like converter cover in a region of the passage opening,
- a second contact, electrically connectable to the first connection piece, and
- a third contact, connectable to the first or a second electronics system; and an electrical connection, via which the third contact is selectively connectable to the first or second contact.

BRIEF DESCRIPTION OF THE DRAWINGS

The invention will be described in greater detail below with reference to an example embodiment. In the drawing.

DETAILED DESCRIPTION OF THE EXAMPLE EMBODIMENTS

Figure 1:
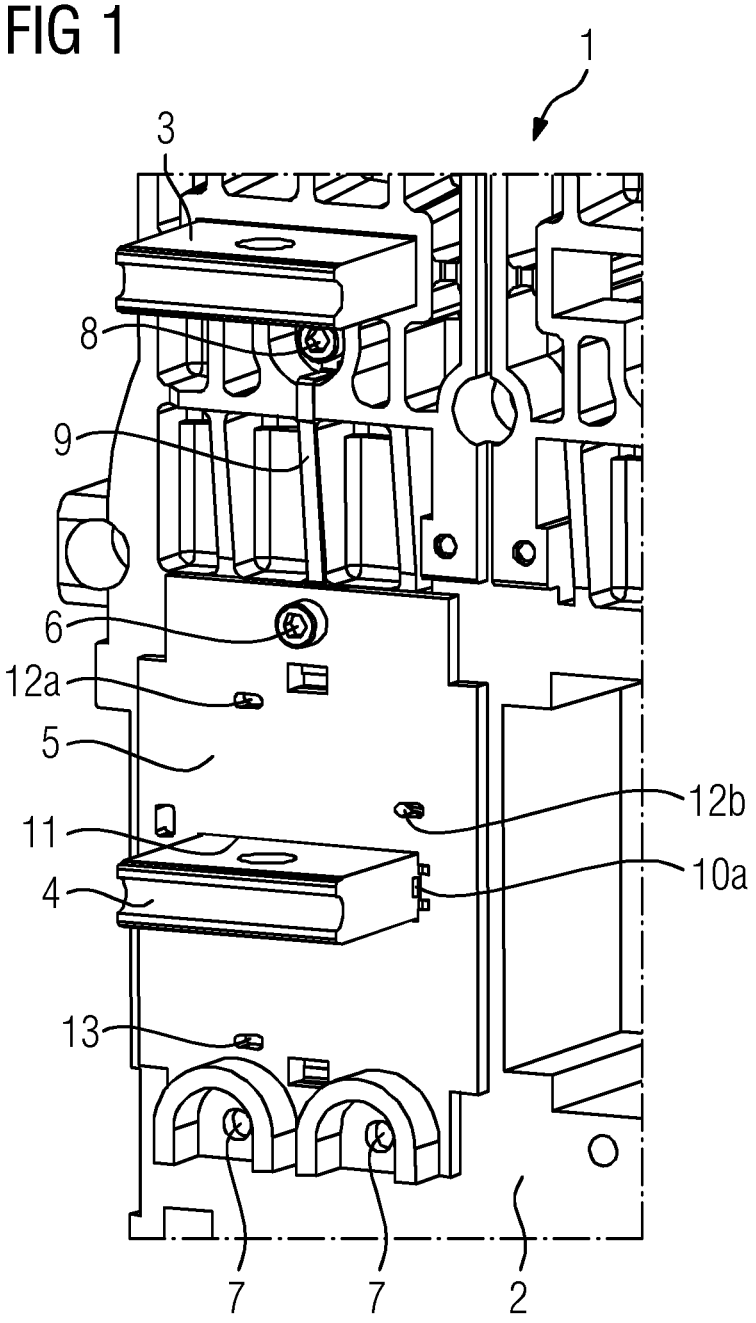
FIG. 1 shows the rear side of the switch housing of a protective circuit breaker with a converter cover into which a voltage tap is integrated.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

At least one embodiment provides that that side of the converter cover which faces the switch housing of the protective circuit breaker has arranged on it: a) a first contact which bears against the second connection piece at the converter cover in the region of the passage opening, b) a second contact which is electrically connected to the first connection piece, and c) a third contact which is connected to the first or a second electronics system, and comprising an electrical connection by way of which the third contact can be selectively connected to the first or second contact.

In a technically simple embodiment, the electrical connection is a wire connection.

In order to change the voltage tap in a simple manner, it is proposed that the wire connection has a plug/a socket at both ends, and the third contact can be selectively connected to the first or second contact by plugging in a plug/being plugged into a socket.

FIG. 1 shows a detail of a protective circuit breaker 1 looking at the rear side of the protective circuit breaker. The protective circuit breaker 1 has a switch housing 2 through which a (first) connection piece 3 and a (second) connection piece 4 extend on the rear side, which connection pieces can each be connected to a feed-side and a load-side busbar.

A region of the switch housing 2 is covered by a plate-like converter cover 5 which is fastened to the rear side of the switch housing 2 via screws 6, wherein only one of the screws 6 is shown in FIG. 1; the two other screws 6, not shown, run through the bores 7. A (first) contact 10 is situated on the side of the lower connection piece 4 and, together with the lower connection piece 4, extends through a passage opening 11 through the converter cover 5.

Figure 2:
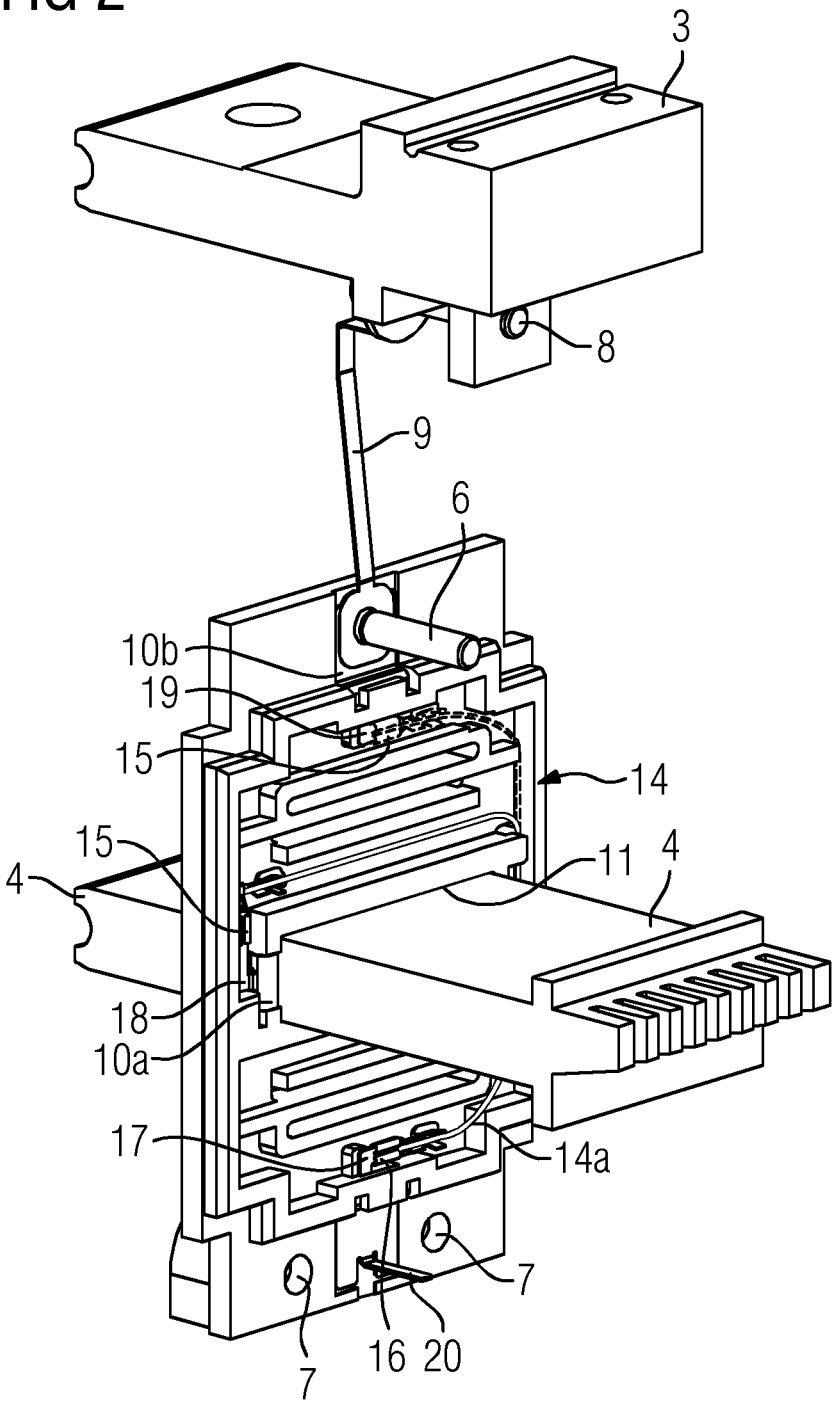
FIG. 2 shows the converter cover according to FIG. 1 with the two connection pieces as seen from the rear side of the switch housing.

The upper connection piece 3 is fastened to the housing via a screw 8 (see FIG. 2). At the same time, the screw 8 electrically connects a strip-like flat metal conductor 9 to the upper connection piece 3, the strip-like flat metal conductor running vertically downward, where it is fastened to the switch housing 2 via the upper screw 6.

Viewing windows 12*a*, 12*b*, 13 in the form of apertures are formed below the screw 6 or somewhat above the bores 7, it being possible to look through the converter cover 5 through the viewing windows.

A converter housing (not shown) is located behind the converter cover 5, the converter housing being inserted into a recess in the switch housing 2, wherein the connection piece 3 runs through a passage opening in the converter housing. A converter coil is arranged in the converter housing around the passage opening and therefore around the connection piece 3 and is connected to a triggering electronics system which is located in the switch housing 2 and triggers opening of the switching contact, for example in the event of a short circuit.

FIG. 2 shows the two connection pieces 3, 4 and that side of the converter cover 5 which faces the housing 2, wherein the housing 2 is omitted here for reasons of clarity.

A wire 14*a* is provided at both of its ends with in each case one first connecting element in the form of a plug socket 15, 16 (or a plug), which plug sockets are mounted onto a corresponding flat plug 17, 18 (or a plug socket), that is to say are each connected to a second connecting element, and in this way establish an electrical connection 14 (signal guide). The alternative connection 14 by mounting onto the flat plug 19 which is associated with a second contact 10*b* is illustrated by the dashed line. However, this means that changing over the manner of connection of the plug socket 15 makes it possible to selectively establish an electrical connection 14 (signal guide) to the contact 10*a* or the contact 10*b*, that is to say to change over to the feed or the load side. The respective setting can be controlled from outside through the viewing windows 12*a*, 12*b*, 13.

The voltage/the voltage tap is connected to an evaluation electronics system of the protective circuit breaker 1 via the pin contact 20 which extends into the converter housing (or switch housing 2).

The process of making contact with the respective connection piece 3 or 4 or the respective busbar is realized by a few components which are easy to fit, wherein the strength and insulation properties of the switch housing 2 are not adversely affected and the signal guide is protected against mechanical damage.

Figure 3:
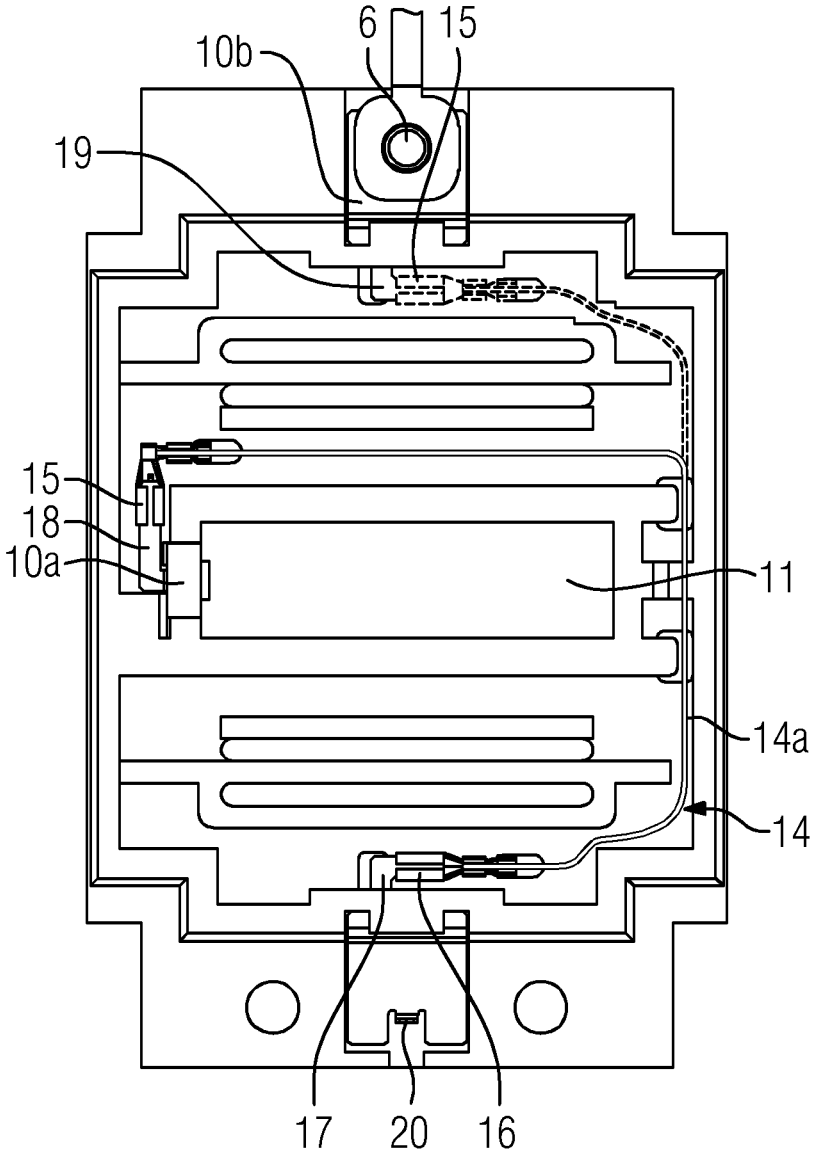
FIG. 3 shows the converter cover according to FIG. 2 without the connection piece.

FIG. 3 shows a plan view of the converter cover 5 according to FIG. 2, without the connection piece 4, from the rear. The viewing windows 12*a*, 12*b*, 13 can each be used to see whether the wire (wire connection 14*a*) is connected to the flat plug 18 or 19, that is to say whether voltage is tapped off by way of the upper connection piece 3 or the lower connection piece 4.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A protective circuit breaker comprising:

a switch housing;

a first and a second connection piece, each of the first and a second connection pieces extending on a rear side through and outside the switch housing and each of the first and a second connection pieces being connectable to a busbar;

a switching contact, arranged in the switch housing, including two contact elements configured to rest against one another when the switching contact is closed and configured to separate from one another when the switching contact is open, wherein at least one of the two contact elements is designed to be movable, and wherein the two contact elements are each respectively electrically connected to a respective one of the first and a second connection pieces;

a converter housing, including a first passage opening, inserted into a recess in the switch housing, wherein the second connection piece runs through the first passage opening;

a converter coil, arranged in the converter housing around the passage opening and around the second connection piece, connectable to a first electronics system to trigger opening of the switching contact;

a plate-like converter cover, covering the converter housing to the outside and including a second passage opening through which the second connection piece extends and runs to the outside, a side of the plate-like converter cover, facing the protective circuit breaker, including arranged on thereon a first contact bearing against the second connection piece at the plate-like converter cover in a region of the passage opening, a second contact, electrically connectable to the first connection piece, and a third contact, connectable to the first or a second electronics system; and an electrical connection, via which the third contact is selectively connectable to the first or second contact.

2. The protective circuit breaker of claim 1, wherein the electrical connection is a wire connection.

3. The protective circuit breaker of claim 1, wherein the electrical connection includes a socket at both ends, and wherein the third contact is selectively connectable to the first or second contact by being plugged onto a plug.

4. The protective circuit breaker of claim 2, wherein the wire connection includes a socket at both ends, and wherein the third contact is selectively connectable to the first or second contact by being plugged onto a plug.

* * * * *